US006464096B2

(12) United States Patent
Adams et al.

(10) Patent No.: US 6,464,096 B2
(45) **Date of Patent: *Oct. 15, 2002**

(54) FITMENT HAVING REMOVABLE MEMBRANE

(75) Inventors: Brian M. Adams, Newark, CA (US); Daniel Luch, Morgan Hill, CA (US); Rodger A. Moody, Castro Valley, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,139

(22) Filed: Apr. 27, 2001

(65) Prior Publication Data

US 2001/0015355 A1 Aug. 23, 2001

Related U.S. Application Data

(63) Continuation of application No. 09/518,115, filed on Mar. 3, 2000, now Pat. No. 6,231,491, which is a continuation of application No. 09/286,266, filed on Apr. 5, 1999, now Pat. No. 6,086,523, which is a division of application No. 09/055,089, filed on Apr. 3, 1998, now Pat. No. 5,957,312, which is a continuation-in-part of application No. 08/808,682, filed on Feb. 28, 1999, now Pat. No. 5,810,184, which is a continuation of application No. 08/380,832, filed on Jan. 30, 1995, now abandoned.

(51) Int. Cl.[7] ..... B65D 51/20

(52) U.S. Cl. ..... 220/258.2; 53/133.2; 53/309; 229/125.05; 229/125.15; 493/87; 220/258.5

(58) Field of Search ..... 215/45; 53/133.2, 53/309; 220/258, 259; 229/125.05, 125.15; 493/87

(56) References Cited

U.S. PATENT DOCUMENTS

| | | | |
|---|---|---|---|
| 2,971,671 | A | 2/1961 | Shakman |
| 3,057,537 | A | 10/1962 | Pollick |
| 3,223,269 | A | 12/1965 | Williams |
| 3,458,080 | A | 7/1969 | Laurizio |

(List continued on next page.)

FOREIGN PATENT DOCUMENTS

| | | |
|---|---|---|
| CA | 685952 | 5/1964 |

(List continued on next page.)

*Primary Examiner*—Stephen P. Garbe
(74) *Attorney, Agent, or Firm*—Dorsey & Whitney LLP

(57) ABSTRACT

A fitment for use as a pour spout for a paper carton or flexible bag for liquids and powders has a flange which may be welded around a hole in the carton or bag. A spout projecting outward from the flange is provided with a removable membrane integral with the interior of the spout. Preferably the membrane is concave. A horizontally disposed pull ring is attached to the membrane by a connector so that pulling the ring removes the membrane by fracturing the tear line at the juncture of the outer edge of the membrane and the projection. A cap snaps over the spout and may be removed by unscrewing the complementary threads on cap and spout. Optionally, a tamper-evidencing band frangibly connected to the lower edge of the cap skirt engages the exterior of the spout so that the cap cannot be removed without breaking the frangible connection. Various means for detachably securing the fitment to a spud during delivery of the fitment from a chute to the interior of a carton are disclosed. In one modification, the membrane is located approximately midway of the height of the fitment spout. The spud is inserted into the spout below the membrane. In other modifications the membrane is near the bottom of the spout and there are downward projections of the fitment which engage the exterior or interior of the spud. The downward projection may be in the form of a ring, preferably interrupted, or fingers or a stud. The ring or fingers or stud may be on the flange or the membrane.

24 Claims, 12 Drawing Sheets

U.S. PATENT DOCUMENTS

| | | | | |
|---|---|---|---|---|
| 3,814,277 | A | | 6/1974 | La Croce et al. |
| 3,990,603 | A | | 11/1976 | Brochman |
| 4,200,196 | A | | 4/1980 | Bashour |
| 4,356,939 | A | | 11/1982 | Fitte |
| 4,380,303 | A | | 4/1983 | Allen et al. |
| 4,391,385 | A | | 7/1983 | Rausing |
| 4,393,979 | A | | 7/1983 | Ball et al. |
| 4,408,697 | A | | 10/1983 | Yoshikawa et al. |
| 4,453,646 | A | | 6/1984 | Harrild |
| 4,461,391 | A | | 7/1984 | Davis |
| 4,513,876 | A | | 4/1985 | Buchner |
| 4,540,102 | A | | 9/1985 | Wiedmer |
| 4,573,601 | A | | 3/1986 | Berglund |
| 4,625,875 | A | | 12/1986 | Carr et al. |
| 4,664,278 | A | | 5/1987 | Barriac |
| 4,669,640 | A | | 6/1987 | Ando et al. |
| 4,682,702 | A | * | 7/1987 | Gach ..... 215/232 |
| 4,708,255 | A | | 11/1987 | Thompson |
| 4,746,025 | A | | 5/1988 | Krautkramer et al. |
| 4,757,911 | A | | 7/1988 | Larkin et al. |
| 4,770,325 | A | | 9/1988 | Gordon et al. |
| 4,801,037 | A | | 1/1989 | Hayashida et al. |
| 4,807,769 | A | | 2/1989 | Gach |
| 4,828,127 | A | | 5/1989 | Young et al. |
| 4,838,450 | A | | 6/1989 | Bocchi |
| 4,850,503 | A | | 7/1989 | Larsson |
| 4,858,776 | A | | 8/1989 | Mehra |
| 4,887,765 | A | | 12/1989 | Rausing |
| 4,948,003 | A | | 8/1990 | Munoz |
| 4,964,562 | A | | 10/1990 | Gordon |
| 5,058,360 | A | | 10/1991 | Yamazaki et al. |
| 5,069,372 | A | | 12/1991 | Kawajiri |
| 5,125,886 | A | | 6/1992 | Dirksing |
| 5,133,486 | A | | 7/1992 | Moore et al. |
| 5,176,300 | A | | 1/1993 | Kishikawa et al. |
| 5,176,313 | A | | 1/1993 | Curry et al. |
| 5,249,695 | A | | 10/1993 | Luch et al. |
| 5,267,934 | A | | 12/1993 | Pape et al. |
| 5,272,855 | A | | 12/1993 | Togi et al. |
| 5,297,688 | A | | 3/1994 | Beck et al. |
| 5,301,849 | A | | 4/1994 | Guglielmini et al. |
| 5,303,838 | A | | 4/1994 | Luch et al. |
| 5,366,433 | A | | 11/1994 | McCormick |
| 5,435,803 | A | | 7/1995 | Owen et al. |
| 5,484,374 | A | | 1/1996 | Bachner et al. |
| 5,498,225 | A | | 3/1996 | Nedstedt |
| 5,597,082 | A | | 1/1997 | Luch et al. |
| 5,601,669 | A | | 2/1997 | Moody et al. |
| 5,653,832 | A | | 8/1997 | Thompson et al. |
| 5,735,426 | A | | 4/1998 | Babcock et al. |
| 5,759,143 | A | | 6/1998 | Blain et al. |
| 5,759,319 | A | | 6/1998 | Moody et al. |
| 5,765,747 | A | | 6/1998 | Lawson |
| 5,770,009 | A | | 6/1998 | Blain et al. |
| 5,810,184 | A | | 9/1998 | Adams et al. |
| 6,086,523 | A | | 7/2000 | Adams et al. |

FOREIGN PATENT DOCUMENTS

| | | |
|---|---|---|
| EP | 0 620 152 A1 | 10/1994 |
| FR | 1523236 | 5/1968 |
| FR | 2645503 | 10/1990 |
| GB | 2238287 | 5/1991 |
| GB | 2276370 | 9/1994 |

* cited by examiner

FITMENT HAVING REMOVABLE MEMBRANE

RELATED APPLICATIONS

This is a Continuation of U.S. patent application Ser. No. 09/518,115 filed Mar. 3, 2000, now U.S. Pat. No. 6,231,491 which is a Continuation of U.S. patent application Ser. No. 09/286,266 filed Apr. 5, 1999, now U.S. Pat. No. 6,086,523 issued Jul. 11, 2000, which is a Divisional of U.S. patent application Ser. No. 09/055,089 filed Apr. 3, 1998, now U.S. Pat. No. 5,957,312 issued Sep. 28, 1999, which is a Continuation-in-Part of U.S. patent application Ser. No. 08/808,682 filed Feb. 28, 1997, now U.S. Pat. No. 5,810,184 issued Sep. 22, 1998, which is a Continuation of U.S. patent application Ser. No. 08/380,832 filed Jan. 30, 1995, now abandoned.

BACKGROUND OF THE INVENTION

1. Field of the Invention

This invention relates to a new and improved fitment having a removable membrane which closes off the interior of the fitment spout. More particularly, the invention relates to a fitment which fits around a hole in a panel of a paperboard carton or other container, used for packaging liquids and powders.

2. Description of Related Art

Fitments having membranes are shown in such patents as U.S. Pat. No. 5,303,838, issued Apr. 19, 1994, and particularly FIGS. 14–16 thereof. Other patents showing membranes are U.S. Pat. No. 3,458,080, issued Jul. 29, 1969, U.S. Pat. No. 4,380,303, issued Apr. 19, 1983, and others. The present invention is an improvement on the prior art in that in some modifications of the invention the membrane is located approximately midway of the height of the spout.

Other fitments are moved from a chute or other source to the interior of a carton by a spud which is attached to the fitment by vacuum. The present invention eliminates the use of vacuum and the mechanical problems inherent therein.

SUMMARY OF THE INVENTION

The fitment of the present invention comprises a spout portion having a peripheral flange which may be welded or otherwise attached to a panel of a paperboard carton or to a flexible plastic container. A spout projects upward from the flange and, in the preferred embodiments, is externally threaded adjacent its upper end. In some modifications of the invention, positioned within the spout is an internal membrane which may be concave and is joined to an inward projection of the spout along a line of weakness. A pull tab, such as a ring, is connected to the membrane in such fashion that by pulling the pull tab the membrane is detached from the inward projection of the spout. The concave membrane facilitates the consumer gripping the ring and has certain advantages in molding the part.

The cap of the present invention has a skirt which is internally threaded to engage the threads of the spout. A lower portion of the cap may have a tear band having a bead which snaps under a shoulder on the lower portion of the spout. The tear band may be connected to the upper portion of the skirt by frangible means so that the cap may not be removed without giving external evidence of tampering.

One of the features of the invention is the fact that the cap may be attached to the spout by pressing the cap downward relative to the spout, the mating threads on the spout and cap skirt slipping past each other and then interengaging. The tamper-evident band has a bead which engages a shoulder on the spout so that the cap cannot be unscrewed without severing the bridges which connect the band to the skirt and giving evidence of tampering.

The tear band not only provides tamper-evidencing in addition to the membrane being intact, it also is an anti-back-off feature to keep the cap from unscrewing during initial distribution.

A particular object and advantage of the present invention is that the fitment is so constructed that, by means of a spud of a mandrel, it may be moved from a chute or other storage location to the carton. In preferred embodiments the mandrel is moved to place the fitment inside the carton and maneuvered so that the spout fits through and extends outside a hole in a wall of the carton. In the prior art, the fitment has been held on the spud by vacuum. This method is undesirable in that a source of vacuum must be provided and, further, drawing the vacuum to a sufficient extent to hold the fitment on the spud is time consuming, as is release of the vacuum.

One means for attachment to the spud is to locate the membrane which seals the spout above the lower end of the spout a sufficient distance for the spud to enter the lower end of the fitment. One means for holding the fitment on the spud is to provide an internal bead near the bottom of the spout which frictionally engages the spud. In a modification of the present invention, such a bead is intermittent rather than continuous. In another version of the invention, vertical internal ribs are formed on the lower end of the spout to grip the spud.

In another modification of the invention, the membrane, if desired, may be positioned at or adjacent the lower end of the spout. A ring depending from fitment engages the exterior of the spud. Optionally, instead of a continuous ring, fingers may project below the flange engaging the exterior of the spud. Such fingers may be rectangular in cross section or hooked. In a further modification, the ring or fingers may engage a groove formed in the spud.

Another optional feature of the invention is to form the connector or post between the pull tab and the membrane of a resilient material and make it longer than the distance between the membrane and the upper end of the spout. With a cap applied to the spout, the pull tab bears against the underside of the top of the cap. When the cap is removed, the post straightens so that the pull tab pops above the upper edge of the spout, where it may be conveniently gripped by the consumer.

In a still further modification of the invention, a curvilinear tear line is formed on the membrane either on the top or bottom surface thereof which intersects the line of weakness between the membrane and the interior of the spout. The post connecting the membrane to the pull tab is preferably located at the intersection of the curvilinear line and the line of weakness. By pulling the pull tab, the membrane tears at the curvilinear line and also tears at the line of weakness, facilitating removal of the membrane.

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION OF THE PREFERRED EMBODIMENTS

Figure 1:
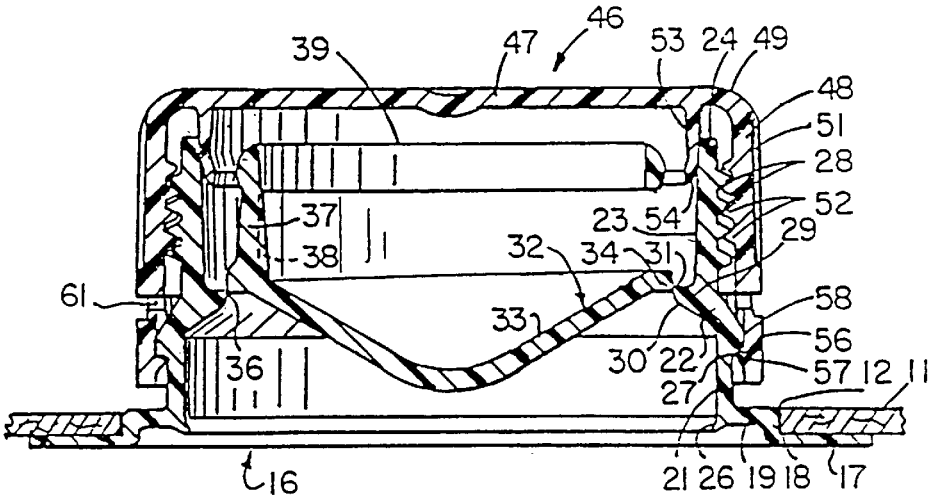
FIG. 1 is a vertical sectional view through the cap and one form of spout in assembled condition.
Figure 3:
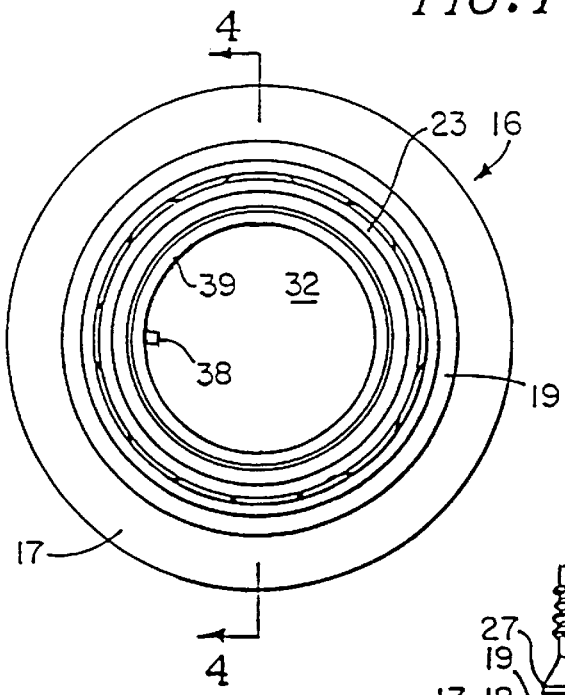
FIG. 3 is a top plan view of the spout of FIG. 1.
Figure 2:
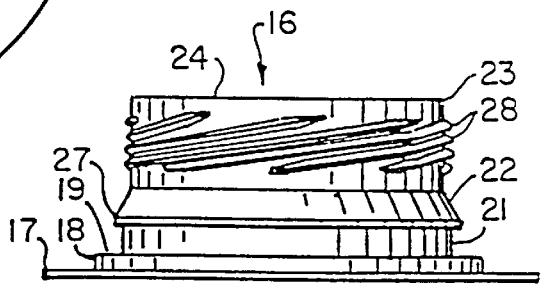
FIG. 2 is a side elevational view of the spout of FIG. 1.
Figure 4:
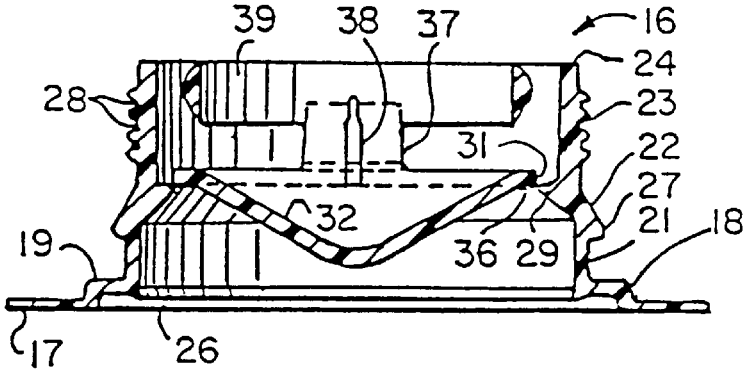
FIG. 4 is a vertical sectional view taken substantially along the line 4—4 of FIG. 3.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

One environment in which the present invention may be employed is by attachment to a carton panel 11 having a hole 12 therein. Fitment 16 is provided with a flange 17 which is welded or otherwise attached to the underside of panel 11 surrounding hole 12. Projecting up from the inner edge of flange 17 there may be a step 18 having an outside dimension to fit within the hole 12 and having a height approximately equal to the thickness of panel 11. Above step 18, the fitment has an inward extending portion 19. Extending upward from the inner edge of portion 19 is lower spout stretch 21 and thereabove is an upward-inward extending slanted stretch 22 which merges into a vertically extending upper stretch 23 terminating in a top edge 24. The inner and outer surfaces of the spout may be termed the "inner wall surface" and "outer wall surface", respectively.

Formed on the inside of the lower portion of lower spout stretch 21 is an inward-downward slanted bead 26 having a purpose which hereinafter appears.

An external shoulder 27 is formed at the juncture of lower spout stretch 21 and slanted stretch 22 for the purpose of attachment to the tamper-evidencing band of the cap as hereinafter explained. On the interior of the spout at approximately the juncture of the slanted stretch 22 and the upper stretch 23 is an inward projection 29 having an upper inner corner 31. The underside of projection 29 and its juncture with lower spout stretch 21 is a curved surface 30 which facilitates dispensing the contents of the container. Projection 29 is positioned upward from the bottom of the spout. On the exterior of upper spout stretch 23 are external threads 28, here shown as eight in number, of an arcuate length of approximately 270°.

Above and inward of corner 31 is membrane 32 molded integrally with the fitment 16. The central portion of membrane 32 may be concave as shown by reference numeral 33. The lower outer edge 34 of membrane 32 joins the upper inner corner 31 of projection 29 and the connection therebetween is thin and constitutes a line of weakness or tear line 36. At one portion of member 32 is an upward connection or post 37 reinforced by thin vertical gusset 38 and connected to horizontal pull ring 39 which is located below the level of top edge 24. When the user grips ring 39 and pulls upward, the tear line 36 breaks and the membrane 32 may be removed.

Cap 46 used with fitment 16 has a top 47 from which depends an upper skirt 48 joined to top 47 by a downwardly rounded corner 49. On the exterior of upper skirt 48 are vertical ribs 51 which assist the user in unscrewing the cap from the fitment. Upper skirt 48 is provided with internal threads 52 mating with the external threads 28 of fitment 16. The shape of the threads is such that when the cap 46 is pressed vertically downwardly on fitment 16, the threads 52 slip over threads 28 and interengage.

In the form of the invention shown in FIG. 1, a hollow plug 53 is formed on the underside of top 47, the lower outer corner thereof having a curved edge 54 which engages the inside of upper fitment 23 in a liquid tight seal.

Optionally, a tamper-evident band 56 is integrally attached to the bottom of upper skirt 48 by means of eight angularly-spaced frangible bridge connections 61, it being understood that the number and placement of such connections is subject to variation. Band 56 is provided with an internal bead 57 which snaps under shoulder 27 when the cap is applied to the fitment. To facilitate engagement of shoulder 27, an internal groove 58 is formed in band 56 immediately above internal bead 57.

Figure 5:
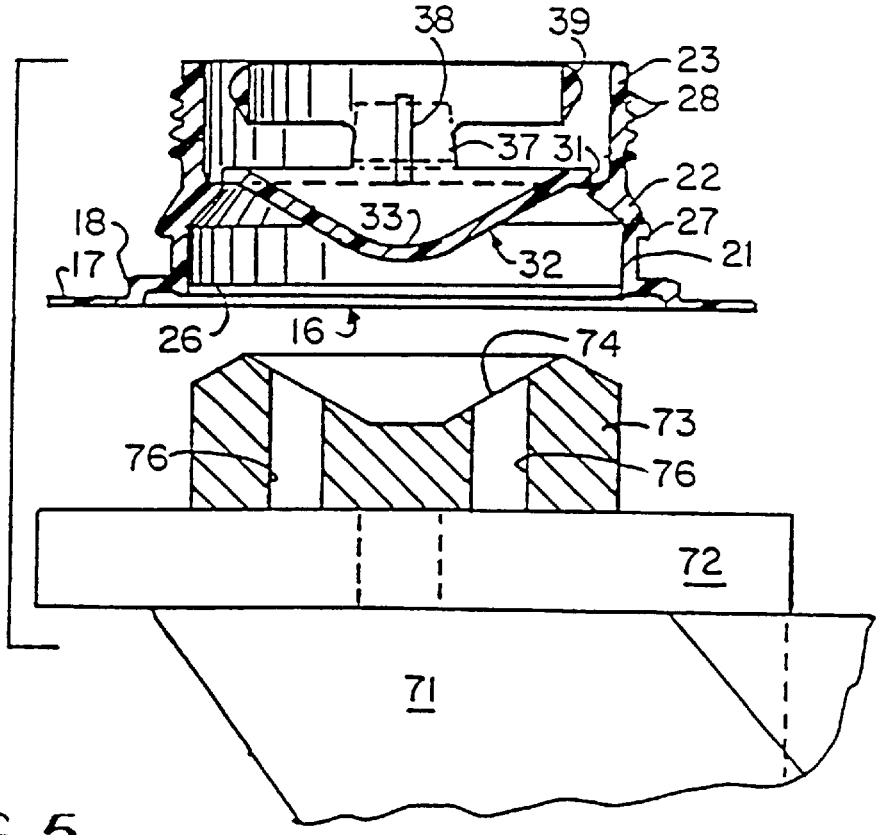
FIG. 5 is a schematic view showing how the fitment may be temporarily attached to the spud of an anvil of a machine for inserting the fitment into a panel of a carton.

Directing attention to FIG. 5, automatic equipment for welding the fitment flange 17 to the underside of panel 11 is known in the art. In one form of such equipment an anvil or mandrel 71 has a flange 72 to which is attached a spud 73 which picks the fitment off of a chute (not shown) by fitting inside the lower spout stretch 21. The lowest portion of concave area 33 of membrane 32 is above the upper edge of spud 73. In the form of the invention shown in FIG. 5, spud 73 has an external diameter such that when it is inserted through the lower end of fitment 16 the inner bead 26 frictionally engages the exterior of spud 73. The spud is formed with a concavity 74 so as not to conflict with the concavity 33 of membrane 32. Holes 76 in spud 73 relieve any vacuum which might tend to impede release of fitment 16 from spud 73 when the fitment has been positioned in the carton panel 11, as shown in FIG. 1.

Figure 6:
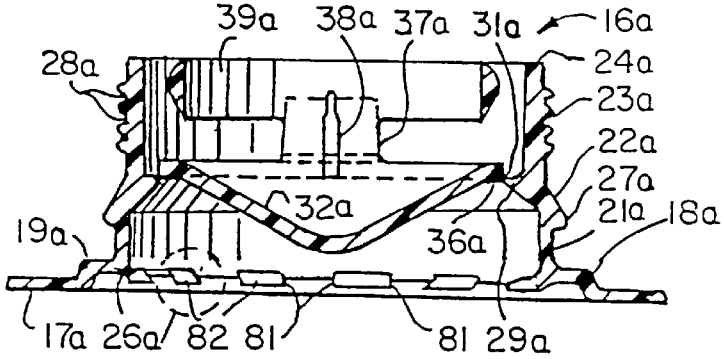
FIG. 6 is a view similar to FIG. 4 showing a modification.
Figure 6A:
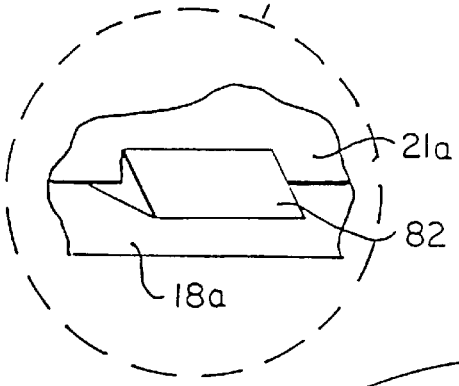
FIG. 6A is an enlarged fragmentary perspective view of a portion of FIG. 6.
Figure 7:
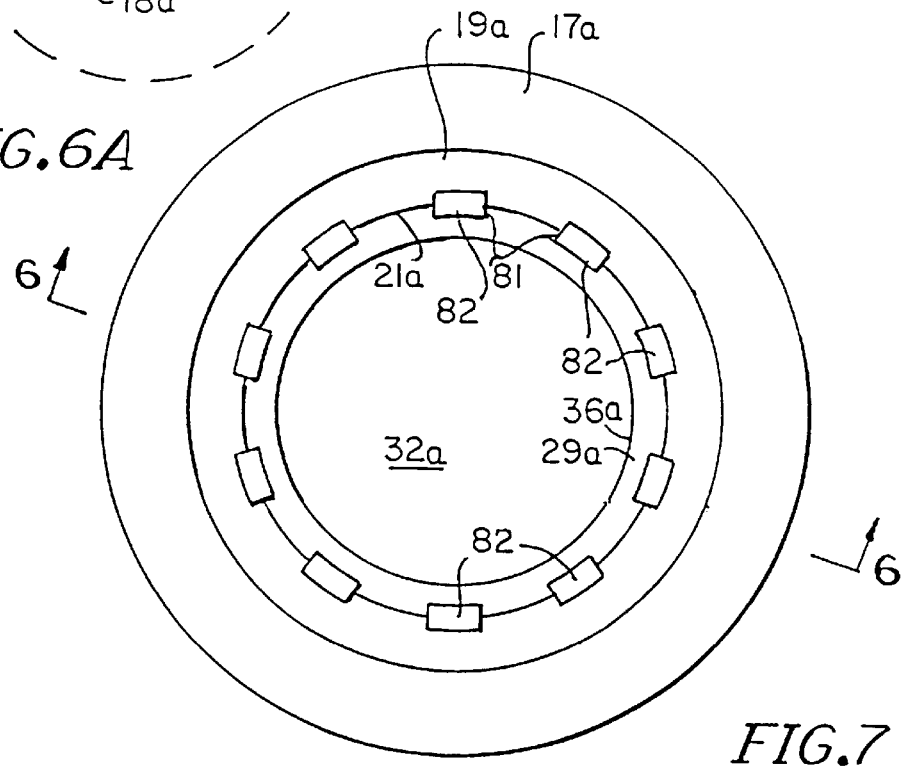
FIG. 7 is a bottom plan view of the structure of FIG. 6.

As shown in FIGS. 6 and 7, inner bead 26 need not be continuous. Bead 26*a* is interrupted, there being gaps 81 between segments 82. The number and placement of gaps 81 is subject to variation. The structure shown makes the bead 26*a* more flexible when engaging spud 76. Further the gaps 81 make it possible to pour out the contents of the carton more completely. As shown in FIG. 6A the upper surfaces of segments 82 slope downward-inward to facilitate engagement with spud 73.

Figure 8:
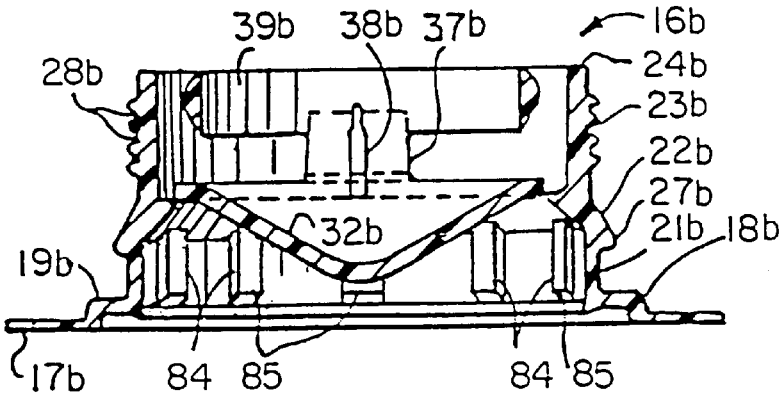
FIG. 8 is a view similar to FIG. 4 of a further modification.
Figure 9:
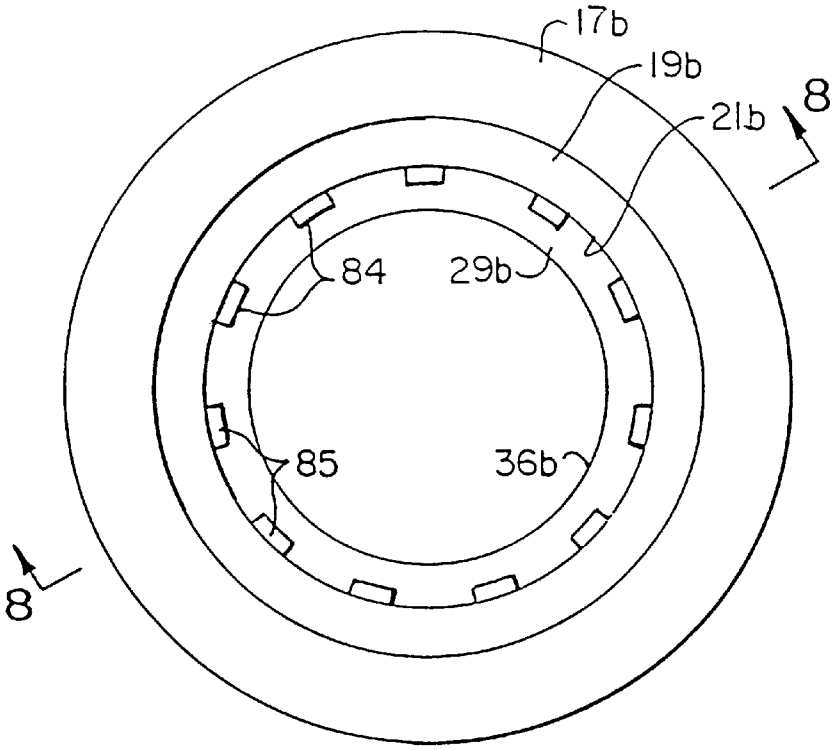
FIG. 9 is a bottom plan view of the structure of FIG. 8.

FIGS. 8 and 9 illustrate a construction wherein the bead 26 is eliminated. Vertical internal ribs 84 are formed extending upward from adjacent the bottom edge of lower spout stretch 21*b*. Such ribs 84 engage the exterior of spud 73 to detachably secure the fitment 16*b* on the anvil 71. The number, width, thickness, and length of ribs 84 is subject to variation. Preferably the lower ends of ribs 84 are formed with downward-outward beveled surfaces 85 to facilitate the ribs 84 slipping over the spud.

Figure 10:
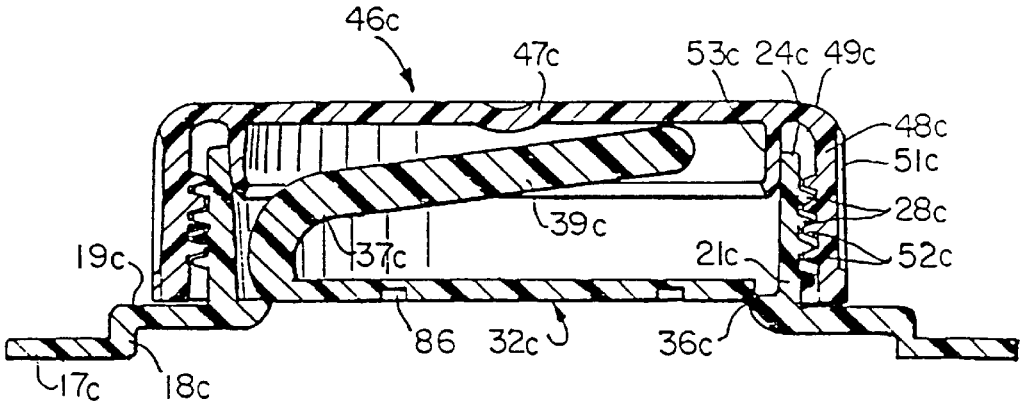
FIG. 10 is a view similar to FIG. 1 of a further modification.
Figure 11:
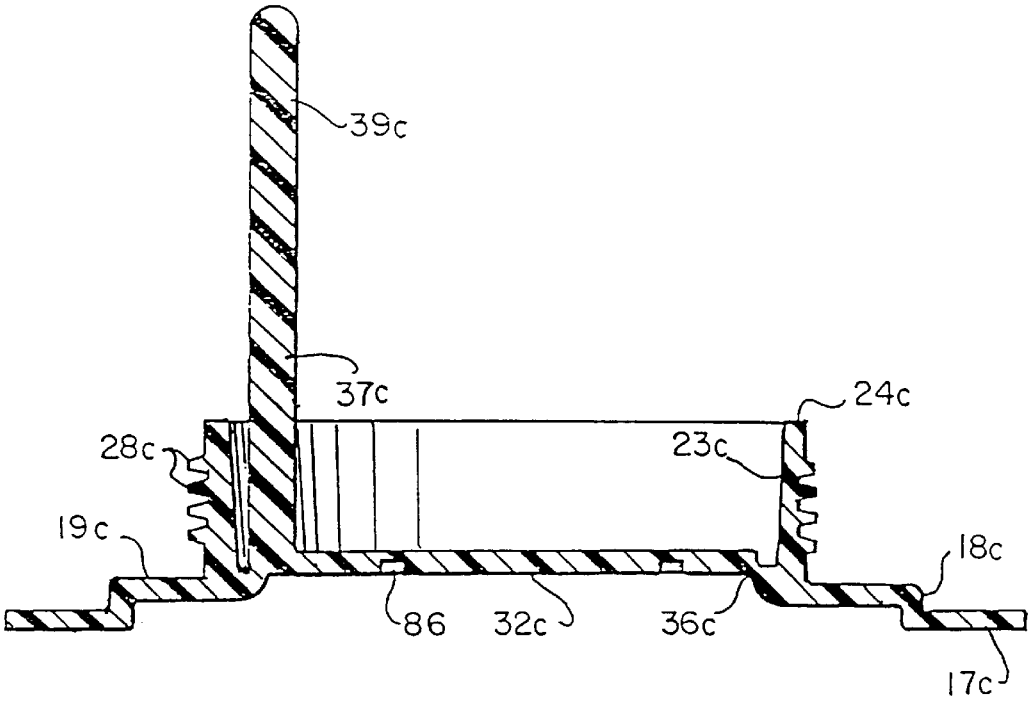
FIG. 11 illustrates the structure of FIG. 10 with the cap removed.

FIGS. 10 and 11 illustrate a still further modification. The connector or post 37*c* is elongated and resilient. Pull tab 39*c* bears against the underside of top 47*c* of cap 46*c*. As shown in FIG. 1, when the cap 46*c* is removed, post 37*c* straightens and tab 39*c* assumes a position above the top edge 24*c* of the upper stretch 23*c* of the spout. Accordingly, tab 39*c* is more easily gripped by the consumer.

Figure 12:
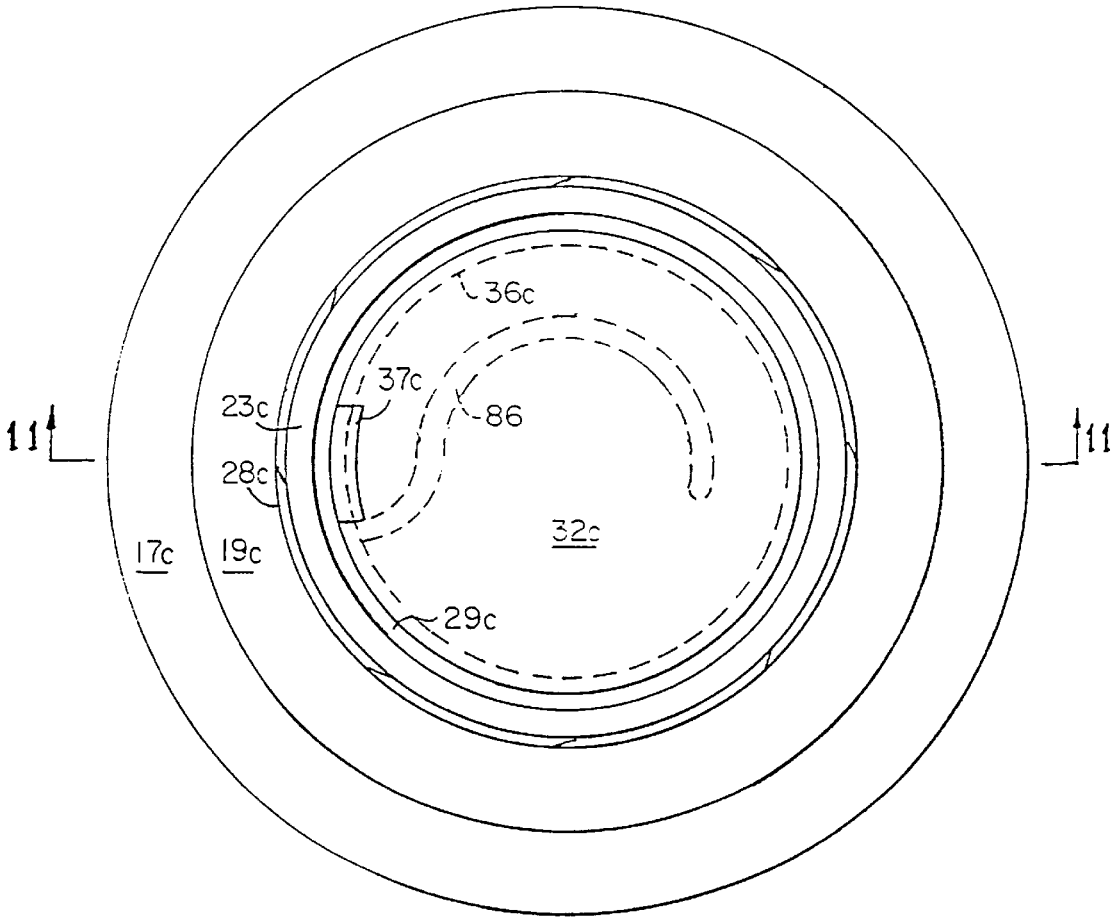
FIG. 12 is a bottom plan view of the structure of FIG. 10.

The modification of FIG. 12 is shown applied to the modification of FIGS. 10 and 11. However, it could be incorporated in any of the other modifications. FIG. 12 shows a modified membrane 32*c* having a curvilinear groove 86 formed on the upper surface or the underneath surface thereof. The post or connector 37*c* connects tab 39*c* to the membrane 32*c* adjacent the intersection of groove 86 with the tear line or line of weakness 36*c*. As shown in FIGS. 10 and 11, the upper inner corner of the inward projection of lower spout stretch 21*c* overlaps with an outer lower corner of membrane 32*c* to form tear line or line of weakness 36*c*. The groove 86 is similar to the groove denominated "51" in U.S. Pat. No. 5,303,838, FIGS. 9–17.

Figure 13:
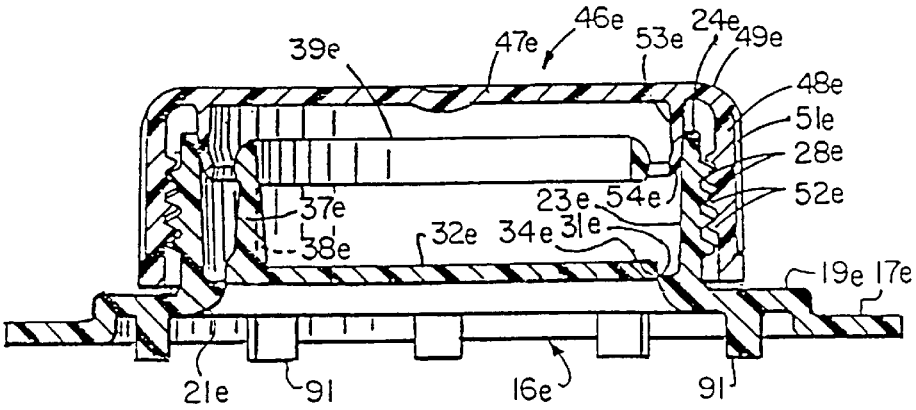
FIG. 13 is a view similar to FIG. 1 of another modification.
Figure 16:
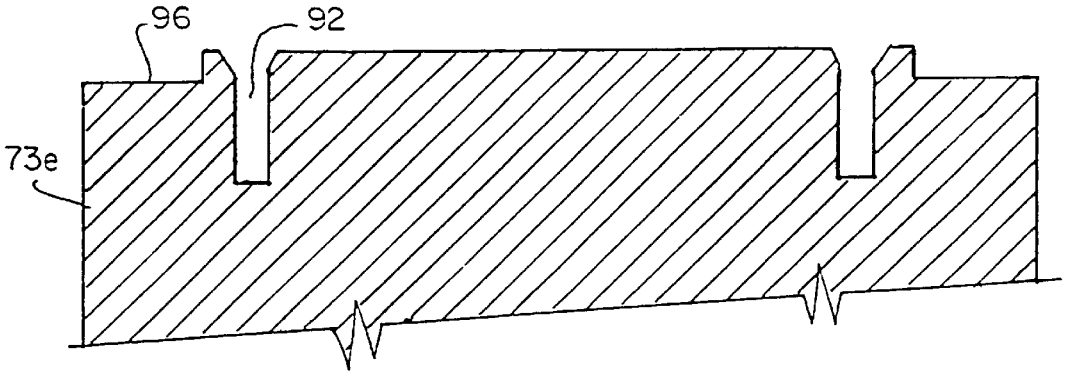
FIG. 16 is a fragmentary sectional view of a spud used with the modifications or example, FIGS. 13 and 17.

Directing attention to FIG. 13, it will be seen that the membrane 32*e* may be located at the bottom edge of lower spout stretch 21*e* or at any desired location above the bottom edge. Attachment to spud 73 of anvil 71 shown in FIG. 16 is accomplished by means of downward extending fingers 91 on the lower surface or of inward extending portion 19*e*. The fingers 91 fit into groove 92 in spud 73*e* to detachably secure the fitment 16*e* thereon. Step 96 of spud 73*e* accommodates flange 17*e* being lower than portion 19*e*. The number of fingers 91, spacing therebetween and length thereof is subject to variation. It will be understood that fingers 91 might be formed on flange 17*e*. It is desirable that fingers 91 be used, rather than a continuous ring in order to facilitate dispensing all the contents of the container.

Figure 15:
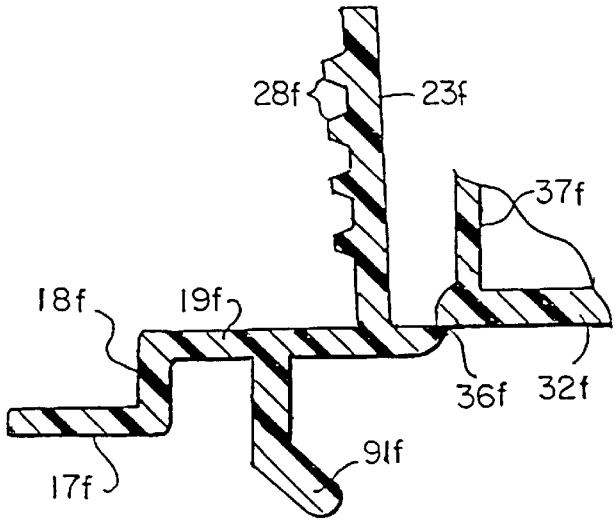
FIG. 15 is a fragmentary view showing a further modification of FIG. 13.

FIG. 15 illustrates that in cross section the fingers 91*f* may be hooked.

Figure 14:
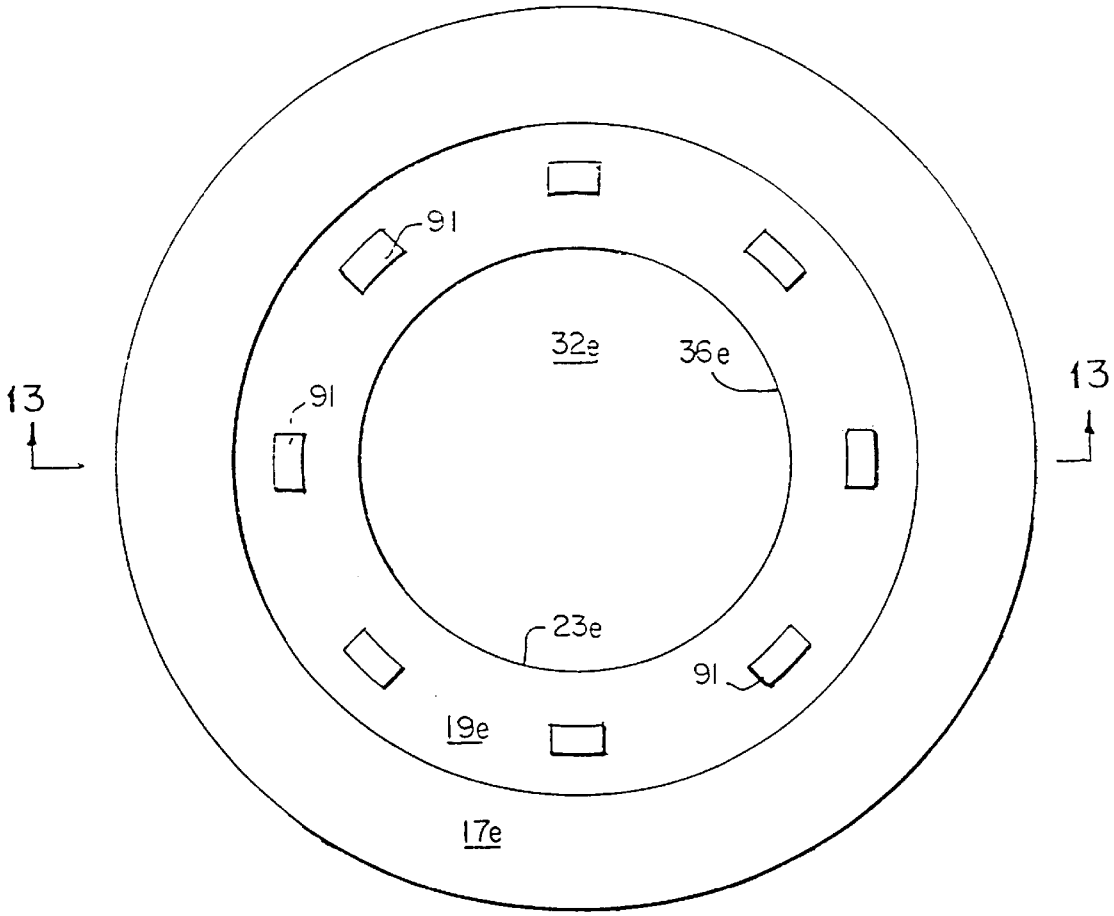
FIG. 14 is a bottom plan view of the modification of FIG. 13.
Figure 17:
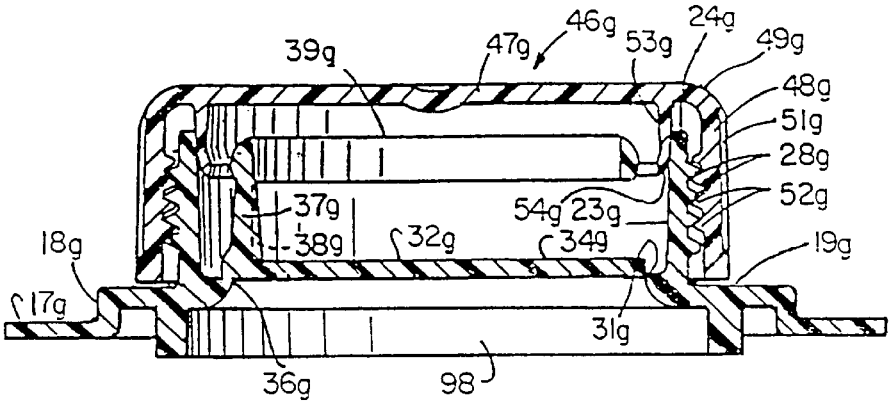
FIG. 17 is a view similar to FIG. 13 of a modification.
Figure 18:
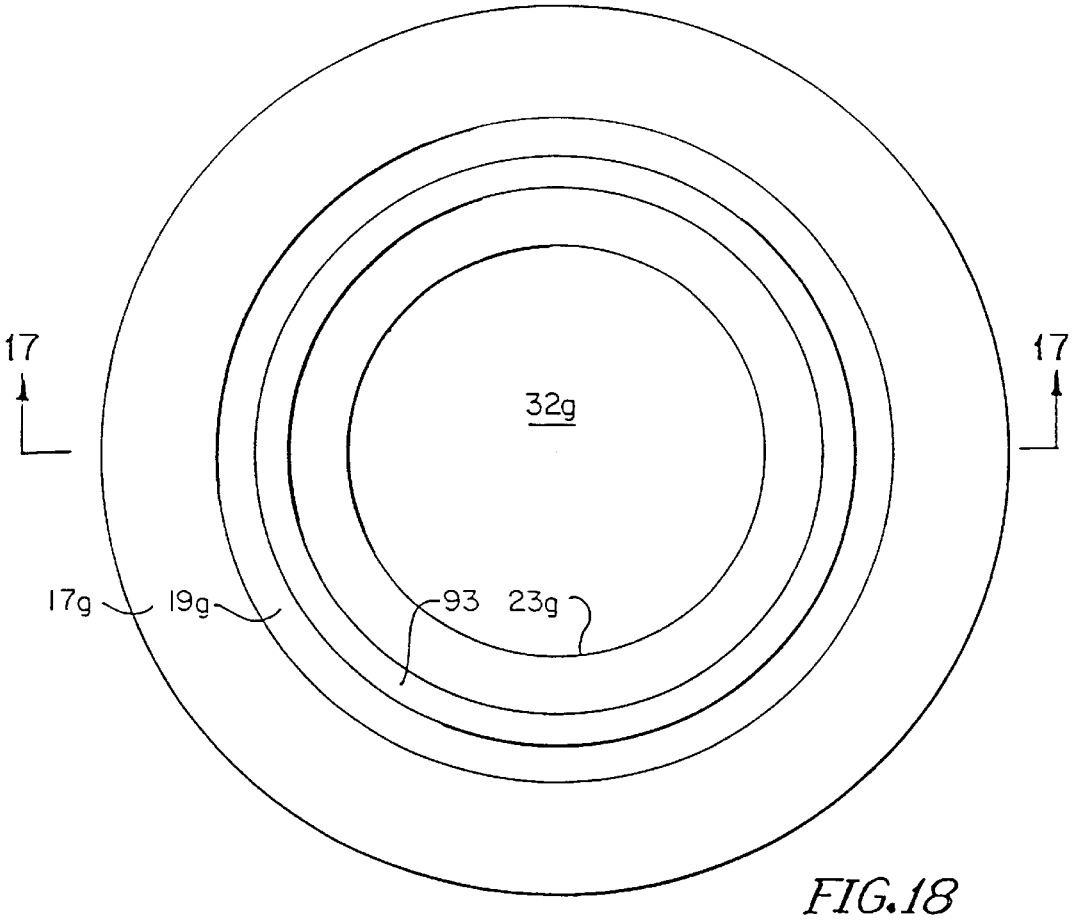
FIG. 18 is a bottom plan view of the modification of FIG. 17.

FIGS. 17–18 illustrate a modification of FIGS. 13–14 where the fingers 91 are replaced by a ring 93 which fits into the groove 92 of spud 73*e* of FIG. 16. Although shown as continuous, ring 93 may be formed with an opening (not shown) to facilitate complete dispensing of the contents of the container.

Figure 19:
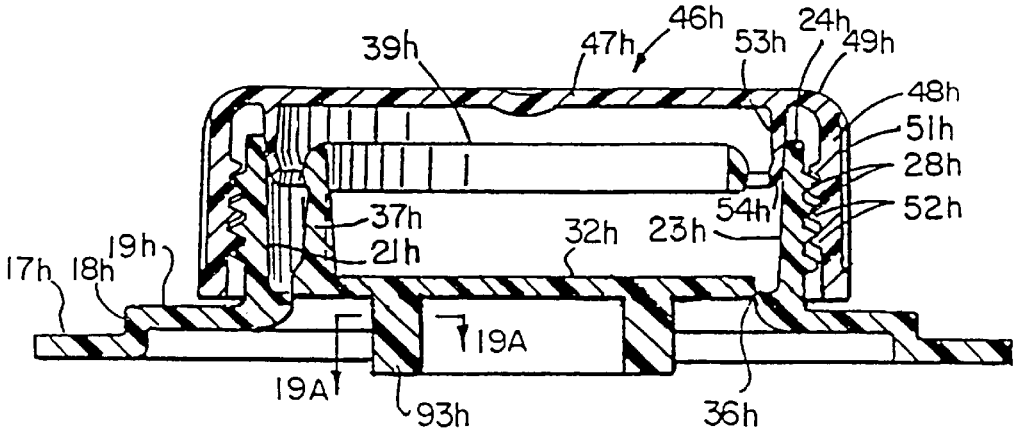
FIG. 19 is a view similar to FIG. 13 of a still further modification.

FIG. 19 is a view similar to FIG. 17 in which ring 93*h* depends from membrane 32*h*. It will be understood that a groove (not shown) in the spud (not shown) which engages ring 93*h* is suitably positioned and dimensioned for such purpose. It will further understood that the position of membrane 32*h* relative to the height of spout stretch 21*h* is also subject to variation.

Figure 19A:
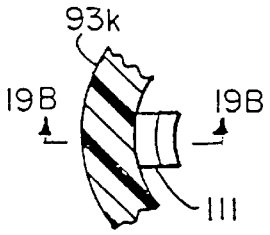
FIG. 19A is a sectional view of a modified structure taken substantially along line 19A—9A of FIG. 19.
Figure 19B:
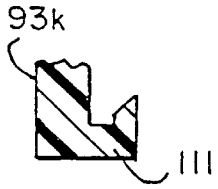
FIG. 19B is a sectional view of the structure of FIG. 19A taken substantially along line 19B—19B of FIG. 19A.
Figure 19C:
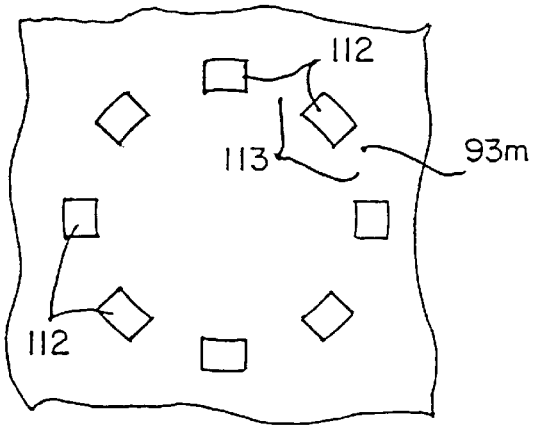
FIG. 19C is a bottom plan view of a further modification of a portion of the structure of FIG. 8.

Ring 93*h* shown in FIG. 19 may be modified, as shown in FIGS. 19A and 19B, by forming hooks 111 on its lower end thereby resembling the hooked ring shown in FIG. 6A. Further, ring 93*m* shown in FIG. 19C may also be interrupted by forming segments 112 therein separated by gaps 113.

Figure 20:
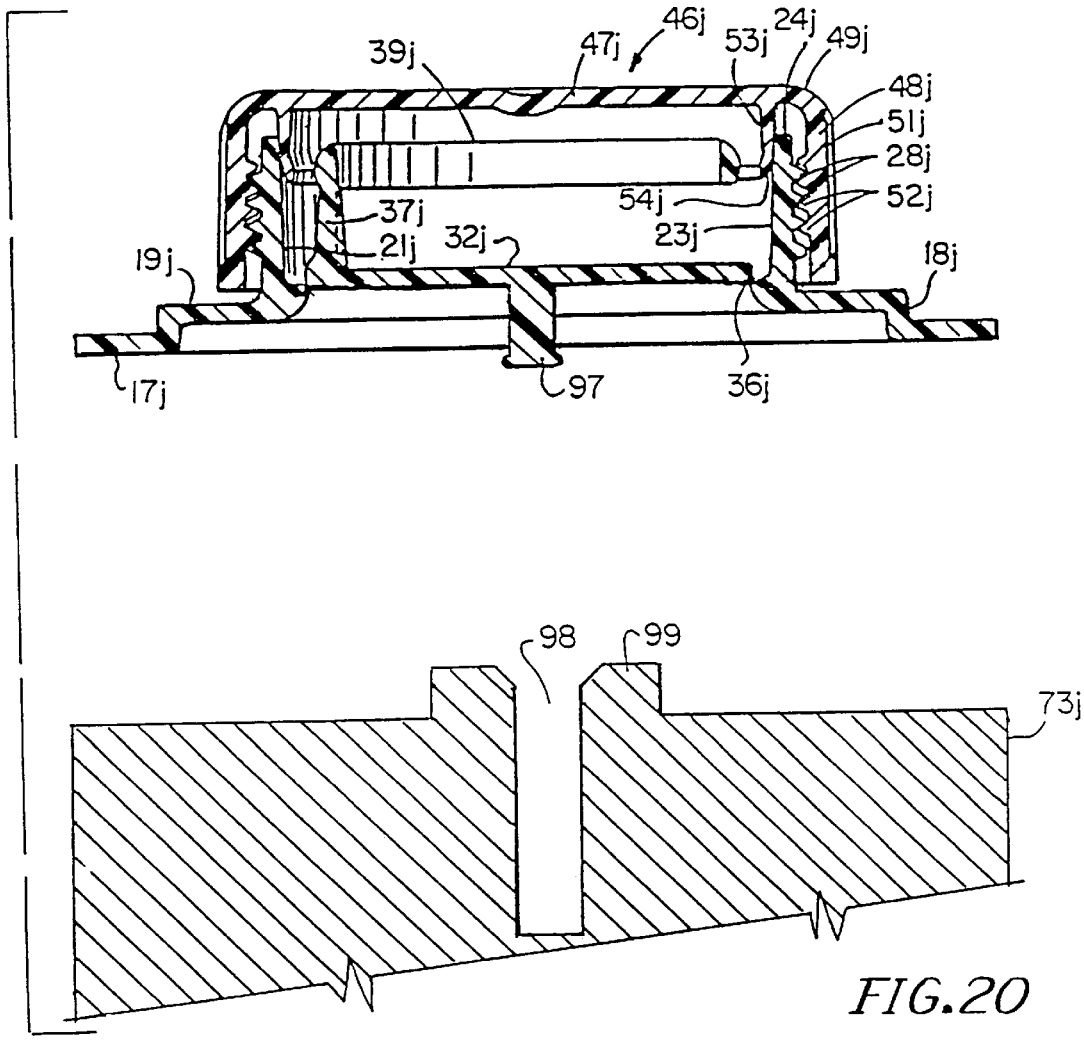
FIG. 20 is a view similar to FIG. 5 of another modification.

FIG. 20 shows a stud 97 depending from membrane 32*j*. Stud 97 is received in bore 98 formed in boss 99 in the upper surface of spud 73*j* or of a mandrel. Stud 97 frictionally engages bore 98 as the fitment is transported from a chute or other source to the carton.

Figure 21:
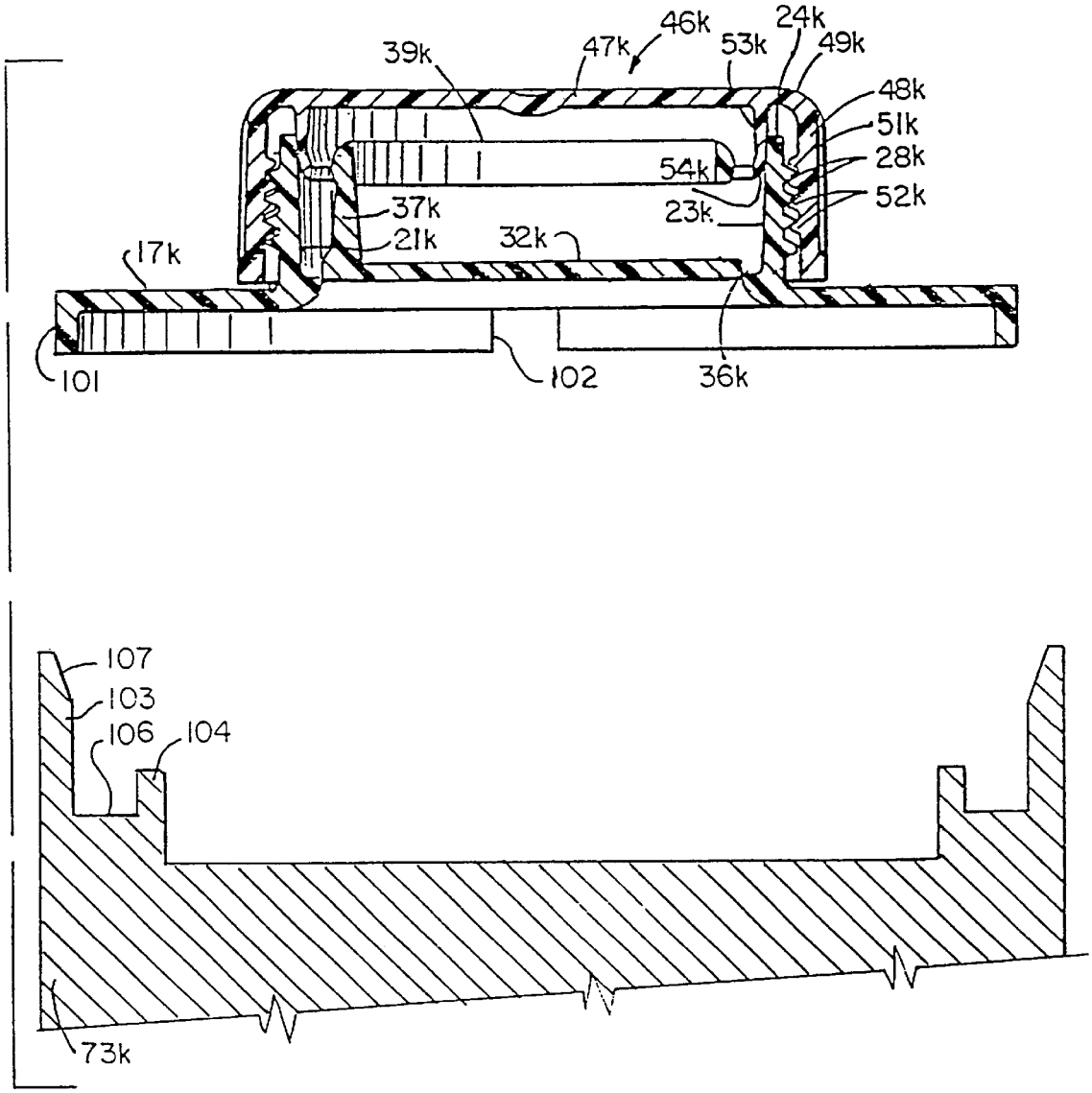
FIG. 21 is a view similar to FIG. 5 of still another modification.

FIG. 21 illustrates a reinforcing ring 101 on or near the periphery of flange 17*k* which depends below flange 17*k*. Preferably openings 102 are formed at one or more locations around ring 101 to facilitate dispensing all the contents of the container. Spud 73*k* may be modified to engage ring 101. Thus an outer ring 103 of greater inside diameter than the outside diameter of ring 101 and preferably formed with an internal upward-outward taper 107 projects above spud 73*k* and engages the outside of ring 101. Inner ring 104 having an outside diameter less than that of the inside diameter of ring 101 also projects above spud or mandrel 73*k*. Groove 106 between rings 103 and 104 frictionally engages ring 101.

In other respects, the modifications of FIGS. 6–7, 8–9, 10–12, 13–14, 15, 17–18, 19, 19A, 19B, 19C, 20, & 21 resemble those of the preceding modifications and the same reference numerals followed by the subscripts a, b, c, e, f, g, h, j, k, and m, respectively indicate corresponding parts.

For purpose of convenience, as used in the accompanying claims, "upper", "lower", "upward", "downward", "above", and "below" refer to the position of the fitment shown in the accompanying drawings. It will be understood that during manufacture, attachment and use, the parts may be positioned in other orientations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A fitment for engaging a fitment holder having a fitment-engaging surface, said fitment comprising, a spout flange, a spout projecting upward from said flange and having an upper portion and a lower portion and an inner wall surface, a membrane sealing off said spout positioned intermediate said upper portion and said lower portion, said membrane having a peripheral edge joined to said inner wall surface along a line of weakness, and an internal bead on said inner wall surface, said bead dimensioned to detachably engage the fitment-engaging surface when the fitment-engaging surface is inserted into said lower portion to prevent unintentional disengagement of the fitment-engaging surface from said fitment.

2. The fitment of claim 1, said inner wall surface further comprising a cylinder above said bead, said cylinder having a height substantially greater than the height of said bead.

3. The fitment of claim 1 in which said bead is interrupted with gaps between segments of said bead.

4. The fitment of claim 1 in which said spout is dimensioned and configured to relieve pressure within said lower portion when the fitment-engaging surface is applied to said lower portion.

5. A fitment for engaging a fitment holder having a fitment-engaging surface, said fitment comprising, a spout flange, a spout projecting upward from said flange and having an upper portion and a lower portion and an inner wall surface, a membrane sealing off said spout positioned intermediate said upper portion and said lower portion, said membrane having a peripheral edge joined to said inner wall surface along a line of weakness, and internal ribs on said inner wall surface, said ribs dimensioned to detachably engage the fitment-engaging surface when the fitment-engaging surface is inserted into said lower portion to prevent unintentional disengagement of the fitment-engaging surface from said fitment.

6. The fitment of claim 1 in which said fitment is dimensioned to detachably engage the fitment-engaging surface by friction.

7. A fitment comprising:

an annular spout flange, a spout projecting upward from said flange having an upper portion a lower portion and an inner and an outer wall surface;

a membrane sealing off said spout, said membrane having a peripheral edge joined to said inner wall surface along a circumferential line of weakness;

said membrane being formed with a serpentine groove extending from said line of weakness inward of said membrane to a terminus remote from said point; and a pull tab joined to said membrane proximate the intersection of said serpentine groove and said line of weakness, said membrane fracturing both on said line of weakness and said serpentine groove when said pull tab is pulled.

8. The fitment of claim 7 in which said inner wall is formed with an inward projection and said peripheral edge is joined to said projection.

9. The fitment of claim 8 in which said projection has a first corner and said edge of said membrane has a second corner, said first corner joined to said second corner at said line of weakness.

10. The fitment of claim 8 in which said projection has an upper inner first corner and said edge of said membrane has an outer lower second corner, said second corner being disposed above and inward of said first corner and joined thereto at said line of weakness.

11. The fitment of claim 8 in which said projection has a first corner and said edge of said membrane has a second corner, said second corner overlapping said first corner to form said line of weakness.

12. The fitment of claim 7 in which said pull tab is a ring.

13. In combination, a spud having a fitment-engaging surface and a fitment, said fitment comprising an annular spout flange, a spout projecting upward from said flange having an upper end a lower end and an inner and an outer wall surface, a membrane integral with said spout sealing off said spout, said membrane having a peripheral edge joined to said inner wall surface along a circumferential line of weakness, said membrane being formed with a serpentine groove extending from a point on said line of weakness inward of said membrane to a terminus remote from said point, and a pull tab connected to said membrane proximate the intersection of said serpentine groove and said line of weakness, said membrane fracturing both on said line of weakness and said serpentine groove when said pull tab is pulled, said fitment being dimensioned to detachably engage said fitment-engaging surface of said spud by friction when said spud is applied to said lower end to prevent unintentional disengagement of said spud from said fitment.

14. The combination of claim 13 in which said inner wall is formed with an inward projection and said peripheral edge is joined to said projection.

15. The combination of claim 14 in which said projection has an upper inner first corner and said edge of said membrane has an outer lower second corner, said second corner being disposed above and inward of said first corner and joined thereto at said line of weakness.

16. The combination of claim 13 further comprising a connector integral with said membrane extending from said point toward said upper end, wherein said pull tab is integral with said connector.

17. A fitment for engaging a spud having an exterior surface, said fitment comprising, a spout having an upper portion, a lower portion and an inner wall surface, a membrane sealing off said spout positioned intermediate said upper portion and said lower portion, said membrane having a peripheral edge joined to said inner wall surface along a line of weakness, and an internal bead on said inner wall surface, said bead dimensioned to detachably engage the exterior surface of the spud when the spud is inserted into said lower portion to prevent unintentional disengagement of said fitment from the spud.

18. The fitment of claim 15 further comprising a spout flange, wherein said spout projects upward from said spout flange.

19. The fitment of claim 18, wherein said spout flange is attached to an underside of a carton panel.

20. The fitment of claim 18, said inner wall surface further comprising a cylinder above said bead, said cylinder having a height substantially greater than the height of said bead.

21. The fitment of claim 18 wherein said bead is interrupted with gaps between segments of said bead.

22. The fitment of claim 18, wherein said spout is dimensioned and configured to relieve pressure within said lower portion when the fitment-engaging surface is applied to said lower portion.

23. The fitment of claim 18, wherein said bead is dimensioned to detachably engage the exterior surface of the spud by friction.

24. The fitment of claim 8, wherein said rib is vertical.

* * * * *